US005769266A

United States Patent [19]

Willbrandt

[11] Patent Number: 5,769,266

[45] Date of Patent: Jun. 23, 1998

[54] LARGE DRINK CONTAINER TO FIT VEHICLE CUP HOLDERS

[75] Inventor: George A. Willbrandt, Fairfax, Va.

[73] Assignee: Berry Sterling Corporation, Evansville, Ind.

[21] Appl. No.: 503,474

[22] Filed: Jul. 18, 1995

Related U.S. Application Data

[63] Continuation-in-part of Ser. No. 186,419, Jan. 28, 1994, Pat. No. 5,433,337.

[51] Int. Cl.[6] ..... B65D 21/02

[52] U.S. Cl. ..... 220/669; 229/400

[58] Field of Search ..... 220/669, 673, 220/675; 229/400

[56] References Cited

U.S. PATENT DOCUMENTS

| | | | |
|---|---|---|---|
| D. 47,527 | 6/1915 | Sanford . | |
| D. 081,984 | 9/1930 | Kirkpatrick | D7/531 |
| D. 110,902 | 8/1938 | Loesch . | |
| D. 116,623 | 9/1939 | Lockwood . | |
| D. 169,370 | 4/1953 | Greenspan | D29/28 |
| D. 198,139 | 5/1964 | Edwards | D44/9 |
| D. 204,783 | 5/1966 | Johnson | D44/9 |
| D. 217,781 | 6/1970 | Stone | D36/8 |
| D. 229,006 | 11/1973 | Sauey | D7/6 |
| D. 239,151 | 3/1976 | Lundin | D7/6 |
| D. 240,286 | 6/1976 | Sarpaneva | D7/11 |
| D. 241,801 | 10/1976 | Colato | D7/14 |
| D. 247,601 | 3/1978 | Schreckengost | D7/9 |
| D. 248,916 | 8/1978 | Reynolds | D7/15 |
| D. 258,483 | 3/1981 | Weinstein | D7/6 |
| D. 274,694 | 7/1984 | Kennedy | D9/352 |
| D. 274,695 | 7/1984 | Kennedy | D9/352 |
| D. 283,477 | 4/1986 | Durand | D7/14 |
| D. 284,923 | 8/1986 | Ritman | D7/15 |
| D. 285,032 | 8/1986 | Alonzo | D7/6 |
| D. 285,637 | 9/1986 | Zieff et al. | D7/9 |
| D. 285,999 | 10/1986 | Ludwick et al. | D7/6 |
| D. 331,684 | 12/1992 | Trombley | D7/536 |
| D. 339,029 | 9/1993 | Schaeppi | D7/536 |
| D. 346,932 | 5/1994 | Cautereels et al. | D7/507 |
| D. 346,933 | 5/1994 | Denny et al. | D7/536 |
| 604,514 | 5/1898 | Belden . | |
| 2,963,256 | 12/1960 | Borah | 248/346 |
| 3,045,887 | 7/1962 | Caine | 229/1.5 |
| 3,079,027 | 2/1963 | Edwards | 220/9 |
| 3,128,029 | 4/1964 | Price et al. | 229/1.5 |
| 3,139,213 | 6/1964 | Edwards | 220/97 |
| 3,342,370 | 9/1967 | Johnson | 229/1.5 B |
| 3,375,954 | 4/1968 | Honkanen et al. | 220/97 |
| 3,484,018 | 12/1969 | Davis | 229/1.5 B |
| 3,612,346 | 10/1971 | Schneider | 220/97 |
| 3,934,725 | 1/1976 | Edwards | 206/519 |
| 4,039,435 | 8/1977 | Narva | 206/217 |
| 4,052,037 | 10/1977 | Mair et al. | 206/519 X |
| 4,061,782 | 12/1977 | Baxter | 426/86 |
| 4,193,494 | 3/1980 | Green | 206/217 |
| 4,231,476 | 11/1980 | Compton et al. | 206/519 |
| 4,273,245 | 6/1981 | Machalek | 215/13 |
| 4,551,366 | 11/1985 | Maruhashi et al. | 428/35 |
| 4,618,066 | 10/1986 | Vail | 215/12 |
| 4,832,202 | 5/1989 | Newman et al. | 206/519 |
| 4,854,468 | 8/1989 | Dahiquist, II et al. | 220/85 |
| 4,869,390 | 9/1989 | Kennedy | 220/90.4 |
| 5,088,673 | 2/1992 | Chandler | 248/311.2 |
| 5,305,911 | 4/1994 | Aylward | 220/675 |
| 5,427,269 | 6/1995 | Willbrandt | 220/669 |
| 5,433,337 | 7/1995 | Willbrandt | 220/669 |

*Primary Examiner*—Steven M. Pollard
*Attorney, Agent, or Firm*—Cooper & Dunham LLP

[57] ABSTRACT

A container, such as a cup, adapted to fit securely in most vehicle container receptacles, with a lower body portion of a diameter to fit standard vehicle container receptacles and an upper body portion of a larger diameter to hold a large volume of beverage.

29 Claims, 5 Drawing Sheets

LARGE DRINK CONTAINER TO FIT VEHICLE CUP HOLDERS

CROSS-REFERENCE TO RELATED APPLICATIONS

This is a continuation-in-part of U.S. patent application Ser. No. 08/186,419, filed Jan. 28, 1994 now U.S. Pat. No. 5,433,337.

BACKGROUND OF INVENTION

1. Field of the Invention

The present invention relates to an improved container, such as a drinking cup, particularly used in conjunction with cup holders, such as those found in cars, boats, trucks, and other vehicles. More particularly, the invention relates to an improved container which can hold large quantities of beverage, yet fit securely in the standard vehicle container receptacle without spilling its contents.

2. Description of Related Art

Most cars contain a receptacle for holding containers, such as cups and cans, so that the beverage will not spill when the vehicle is moving. These standard vehicle container receptacles are generally sized to receive an aluminum can typically used with soft drinks having a cylindrical shape and a diameter of about 2¼ inches. Oftentimes larger beverage containers, e.g., having a capacity of over 21 ounces, have a diameter of greater than 2½ inches and do not fit into the vehicle container receptacle. These larger beverage containers must either be held by the driver or passenger, or placed elsewhere in the car where they are likely to spill their contents.

To cope with this problem, most cups, especially those used in drive-thru food services, are limited to a size that will fit a standard vehicle container receptacle. However, traditionally styled cups which fit standard vehicle container receptacles are limited to a volume of about 21 ounces. Specifically, when a container larger than 21 ounces is designed to fit the standard vehicle container receptacle the container is top heavy when filled with liquid. It has been recognized in the art that, to offset this problem, it would be desirable to design a container which would fit snugly into a standard vehicle container receptacle and would not tip or spill its contents during movements of the vehicle, even in a sudden turn or stop.

One method which allows larger containers to fit in standard vehicle container receptacles involves the use of an adapter. The adapter modifies the standard vehicle container receptacle to a size such that larger containers can be accommodated by the standard vehicle container receptacle. Dahlquist II et al., U.S. Pat. No. 4,854,468, and Chandler, U.S. Pat. No. 5,088,673, disclose container adapter devices designed so that a standard vehicle container receptacle can accommodate containers that are too large to fit in the standard vehicle container receptacle.

Of late, cups designed with a base proportioned to fit the standard vehicle container receptacle having a main body portion of a size larger than the base have attempted to overcome the problems of the limited container volume and top heaviness. However, these designs still cannot hold a very large volume of beverage, and are made of heavy materials, such as glass, to reduce top heaviness. The GOJO™ cup manufactured by Highwave, Inc. is an example of this type of design.

While the prior art discussed above provides important advantages, the prior art does not provide a container which can hold a large volume of liquid and yet fit the standard size vehicle container receptacle without being top heavy.

SUMMARY OF THE INVENTION

According to the invention, a beverage container (also referred to herein as a "container") is provided which is sized to fit securely in a standard vehicle container receptacle and still accommodate up to 64 ounces, and preferably about 22 to about 64 ounces, of a beverage. The container may comprise a base and a lower body portion extending substantially upward from the base. A shoulder may extend radially outward from the lower body portion and an upper body portion may extend substantially upward from the shoulder. The upper body portion may be opened at the top to create an opening. The lower body portion has a size to fit in the standard vehicle container receptacle. The shoulder aids the container in securely nesting in the vehicle container receptacle. The upper body portion is of a size such that the container holds the desired amount of a beverage.

In order to strengthen the sidewalls of the lower body portion and to facilitate material flow in manufacture of the upper body portion, the lower body portion of the container may be formed of a series of fluted sides that provide support to the lower body portion. Further, an accompanying lid provides additional strength to the upper body portion of the container. The sides of the lower body portion and the upper body portion may increase, decrease, or substantially stay the same in thickness as they extend upward from the base to the shoulder and from the shoulder to the top of the upper body portion. The thickness of the walls may be chosen to improve material flow to the upper body portion during manufacturing, increasing manufacturing speeds for cost reductions and increasing production outputs. Since the material flow can be improved, the container can be made from relatively thin injection molded plastic, paper or other suitable combination of composite materials known to those skilled in the art.

Another embodiment of the invention is directed to a method of increasing the strength of a container comprising a base, a lower body portion extending substantially upward from the base, a shoulder attached to and extending radially outward from the lower body portion, and an upper body portion extending upwardly from the lower body portion. The method may comprise including in the lower body portion a plurality of vertically fluted sides which strengthen the entire container, and an accompanying lid which further strengthens the upper body portion.

As pointed out in greater detail below, the container of this invention provides important advantages. Additionally, the container fits standard food service dispensers, disposable lids, and food service straws so that the container can be incorporated for use with existing beverage dispensing machines, such as those used in fast food restaurants.

BRIEF DESCRIPTION OF THE DRAWINGS

The invention itself, together with further objects and attendant advantages, will best be understood by reference to the following description, taken in conjunction with the accompanying drawings, in which.

DETAILED DESCRIPTION OF THE PREFERRED EMBODIMENTS

The preferred embodiments of the invention will be described below in conjunction with a cup for a beverage.

The cup (or container) comprises a base 12 and a lower body portion 14 extending substantially upward from said base. The cup further comprises a shoulder 16 extending radially outward from said lower body portion, and an upper body portion 18 extending substantially upward from said shoulder to create an opening. The overall diameter of the lower body portion 14 is such that the lower body portion 14 is of a lesser diameter than the upper body portion 18.

Figure 1:
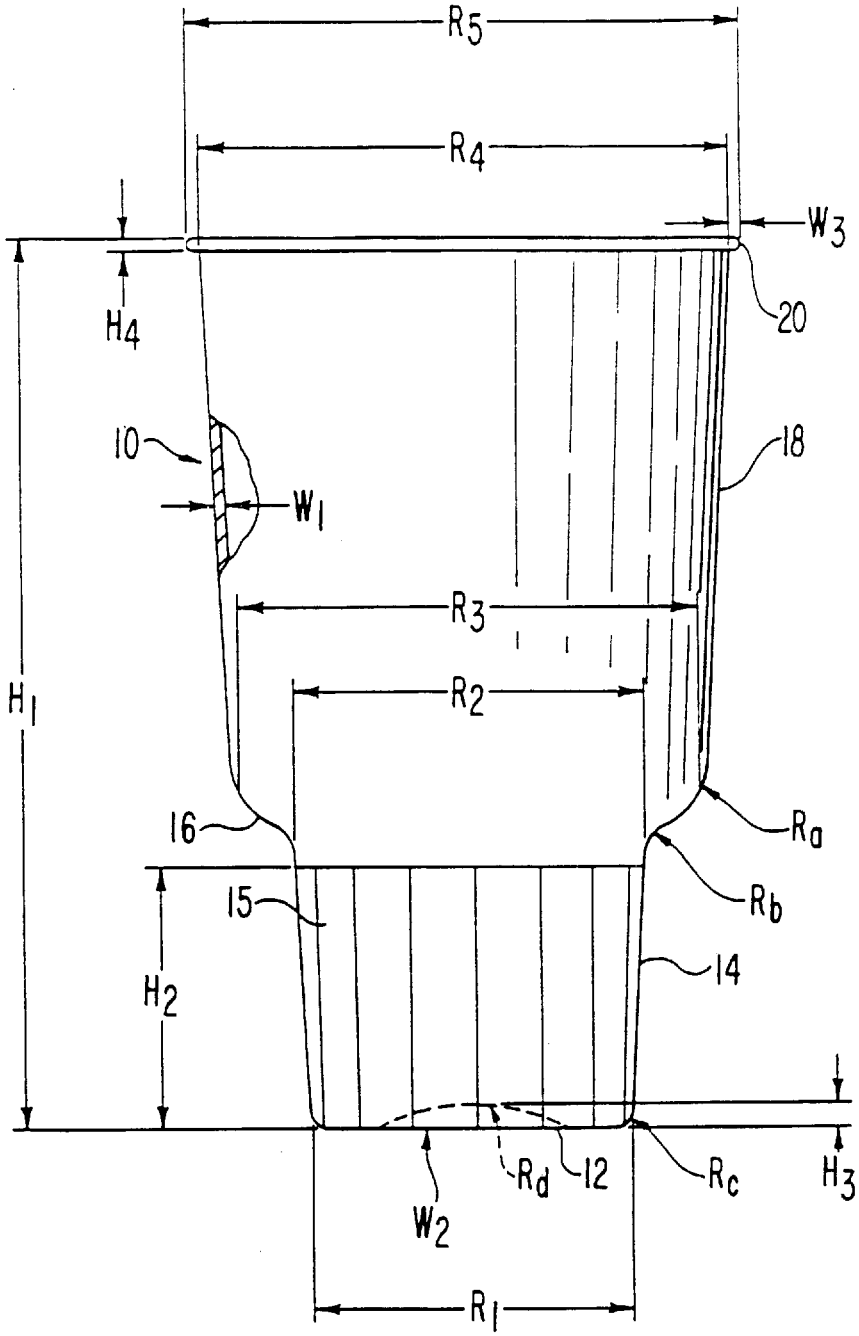
FIG. 1 is a side view of an embodiment of the container of this invention.
Figure 2:
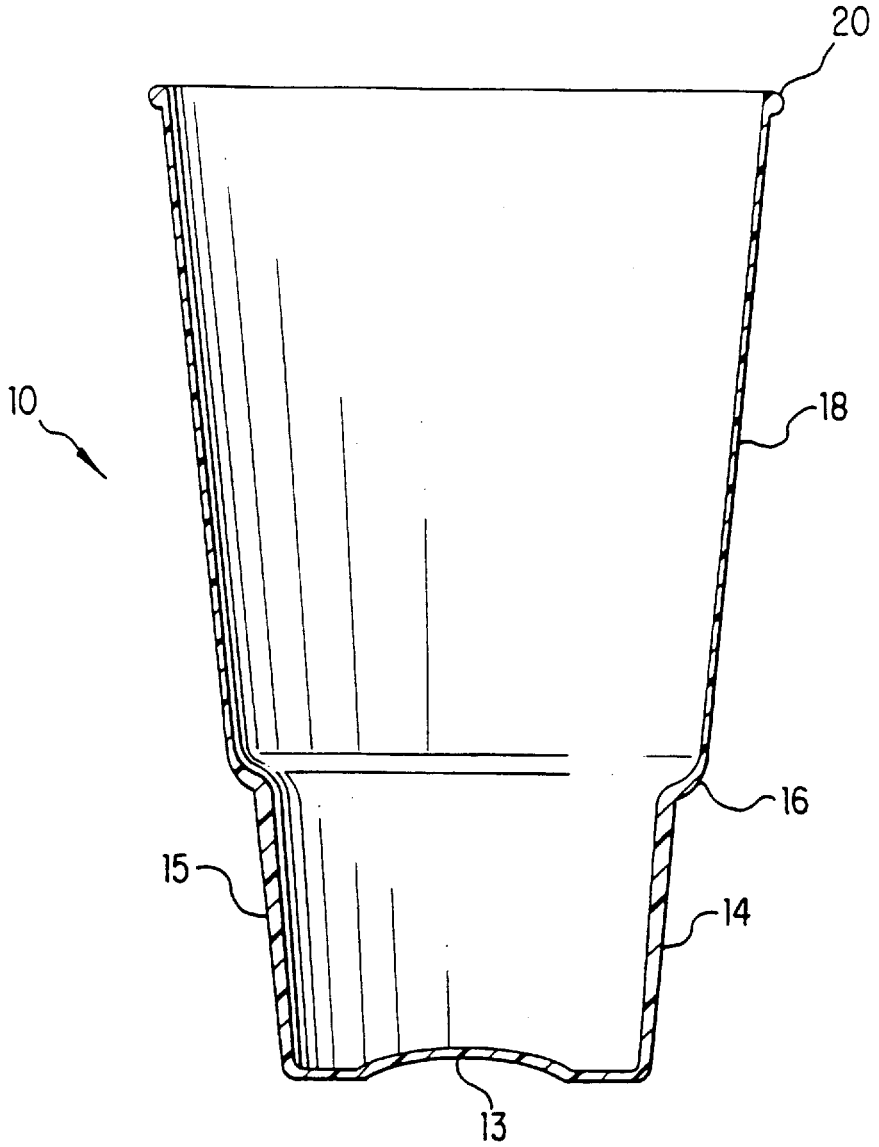
FIG. 2 is a sectional view of the embodiment of FIG. 1 of the container of this invention.

Turning now to the details of the drawings, FIG. 1 shows the preferred embodiment of a cup designated generally by the numeral 10, and FIG. 2 shows a sectional view of the cup 10. The cup 10 includes a substantially circular base 12 attached to a lower body portion 14. The thickness $W_2$ of the base 12 may be about 0.020 to about 0.040 inches. The preferred thickness $W_2$ of the base 12 may be about 0.015 to 0.045 inch. The lower body portion 14 may increase in diameter from the base 12 extending upward toward a shoulder 16. The typical diameter for a vehicle container receptacle is about 2½ inches. Thus, the base 12 and the lower body portion 14 are of a diameter to provide a secure fit for the cup in the vehicle container receptacle. The lower body portion 14 may have a diameter $R_1$ of about 2¼ inches to about 2⅜ inches at the base 12 and a diameter $R_2$ of about 2¼ about 2⅞ inches at the top thereof. Preferably, the diameter $R_1$ of the lower body portion 14 ranges in size from about 2½ inches to about 2¾ inches, with the most preferred size of $R_1$ being about 2½ inches at the base. The diameter $R_2$ of the lower body portion 14 is about 2½ inches to about 3.0 inches, with the most preferred size of $R_2$ being about 2¾ inches where the lower body portion 14 meets the shoulder 16. Where the lower body portion 14 meets the base 12, the corners are tapered and have a radius $R_c$ of about 0.0930 inch. The overall diameter of the lower body portion 14 is such that the lower body portion 14 is of a lesser diameter than the upper body portion 18.

The side walls may increase, remain constant, or decrease in thickness moving upward from the base 12 to shoulder 16. Fluted sides 15 may be utilized to provide lateral support to the lower body portion 14 of the cup 10 and facilitate material flow in manufacture of the upper body portion 18 so that the cup 10 can be made of a relatively thin material, such as paper, plastic or similar materials and still hold approximately 22 to 64 ounces of beverage. The number of fluted sides may be eight, and in one embodiment, the cup may have sixteen fluted sides.

Figure 3:
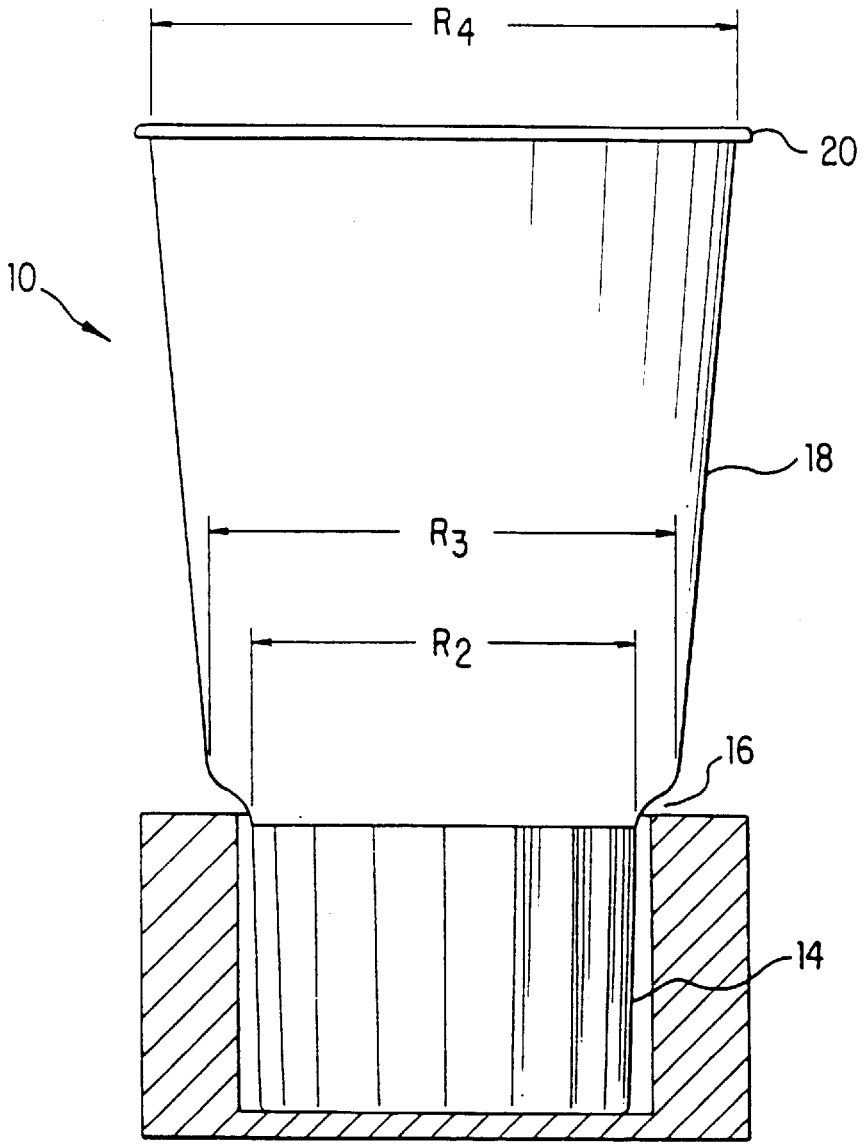
FIG. 3 is a side view of the container of this invention seated in a vehicle container receptacle (shown in section)

As shown in FIGS. 1 and 3, the lower body portion 14 may be of an axial length $H_2$ such that it can maintain a restrained configuration and not inadvertently dislodge from the standard vehicle container receptacle. The lower body portion 14 may have an axial length $H_2$ of about 1¾ inches to about 2½ inches, preferably about 2 inches to about 2⅛ inches. In one preferred embodiment, the lower body portion 14 is about 2 inches in axial length and the sides of the lower body portion 14 abut against the support structure of the vehicle cup receptacle and prevent the lower body portion 14 from dislodging inadvertently from the vehicle cup receptacle.

The shoulder 16 may extend radially outward from the lower body portion 14 and form a transitional surface between the lower and upper body portions 14 and 18. At the point where the shoulder 16 meets the lower body portion 14, the shoulder 12 may have a radius R of about 3/16 inch extending to a radius R of about 5/16 inch where the shoulder 16 attaches to the upper body portion 18. As shown in FIG. 3, the shoulder 16 is designed to provide a stabilizing area between the lower and upper body portions 14 and 18 that rests against the vehicle cup receptacle. The height of the shoulder 16 may vary from about ⅛ inch to about 1 inch, preferably from about ½ inch to about ¾ inch. In one preferred embodiment, the shoulder 16 may be about ¾ inch in height.

Returning to FIG. 1, extending upward from the shoulder 16, the upper body portion 18 may have a smooth wall surface and may increase in diameter as it extends upward toward a rim 20. The upper body portion 18 may have a substantially constant thickness $W_1$ of about 0.015 to about 0.045 inches. In one preferred embodiment, the thickness $W_1$ may be 0.030 inch. The upper body portion 18 may have a lower diameter $R_3$ (at the shoulder 16) of about 2.750 inches to about 3.500 inches, preferably about 2.875 inches to about 3.450 inches, and most preferably about 2.875 inches to about 3.420 inches. In one preferred embodiment, the upper body portion may have a lower diameter $R_3$ of about 3.225 inches. The upper body portion 18 may have an upper diameter $R_4$ (at the point where it forms an opening) of about 3.800 to about 4.650 inches, preferably about 3.850 to about 4.100 inches, and most preferably about 3.900 to about 4.100 inches. In one preferred embodiment, the upper body portion 18 may have an upper diameter $R_4$ of about 3.900 inches.

The axial length of the upper body portion 18 may vary from about 3.00 inches to about 9.00 inches, preferably from about 4.750 inches to about 5.125 inches. In one preferred embodiment, the upper body portion 18 may have an axial length of about 4.9375 inches so that the cup can hold about 32 ounces of a beverage. In addition, an axial length of 4.9375 inches provides a large printing area on the upper body portion 18 so that logos printed on the cup 10 are completely visible even when the cup 10 is resting in a vehicle cup receptacle. In one preferred embodiment, the total axial length $H_1$ of the cup 10 is about 6.9375 inches.

Figure 4:
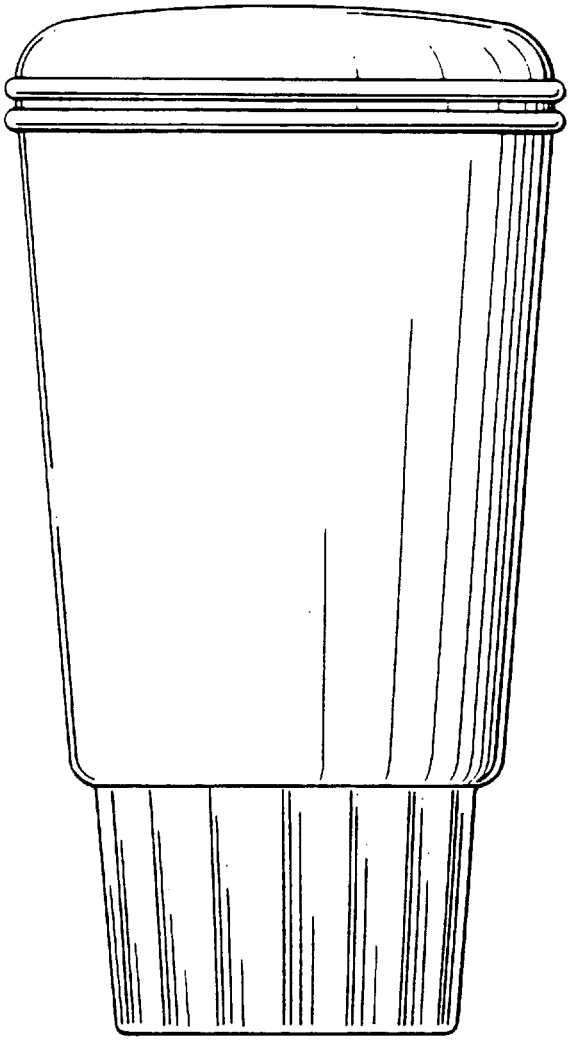
FIG. 4 is a side view of an embodiment of the container with a lid.

At its upper diameter, the upper body portion 18 may be surrounded by a rim 20. The rim 20 is provided so that a molded lid as shown in FIG. 4, preferably semi-circular in shape, may fit securely on the cup 10. The molded lid, when inserted on top of the cup 10 strengthens it and makes the cup 10 rigid, steady, and spillproof. However, the cup 10 is also functional without the molded lid. The cup 10 will not collapse if it is filled with liquid, and the molded lid is not attached to the opening of the cup 10. The molded lid can be made from the same type of material as the cup 10 or from any other suitable material.

Because of the increased strength of the upper body portion 18 when secured with the molded lid, the cup 10 does not require a stacking shoulder found in conventional plastic and paper cups. Thus, the rim 20 can be reduced from the standard height of about ¾ inch to a height $H_4$ ranging from about 1/16 inch to about ½ inch, and preferably the height of the rim is about 1/10 inch to about ¼ inch. In one preferred embodiment, the rim 20 is about 1/10 inch in height. The narrower rim 20 allows for better nesting of the cup 10 and thus the number of cups that can be packed in a case is increased.

The width (thickness), $W_3$, of the rim 20 may be about 0.030 inch to about 0.30 inch, preferably about 0.15 inch to about 0.25 inch, and most preferably about 0.18 inch to about 0.25 inch. In a preferred embodiment, the width of the rim may be about 0.22 inch. The diameter $R_5$ of the cup is about 3.1 to about 6.00 inches. In one preferred embodiment, the diameter $R_5$ of the cup 10 may be about 4.120 inches.

Figure 5:
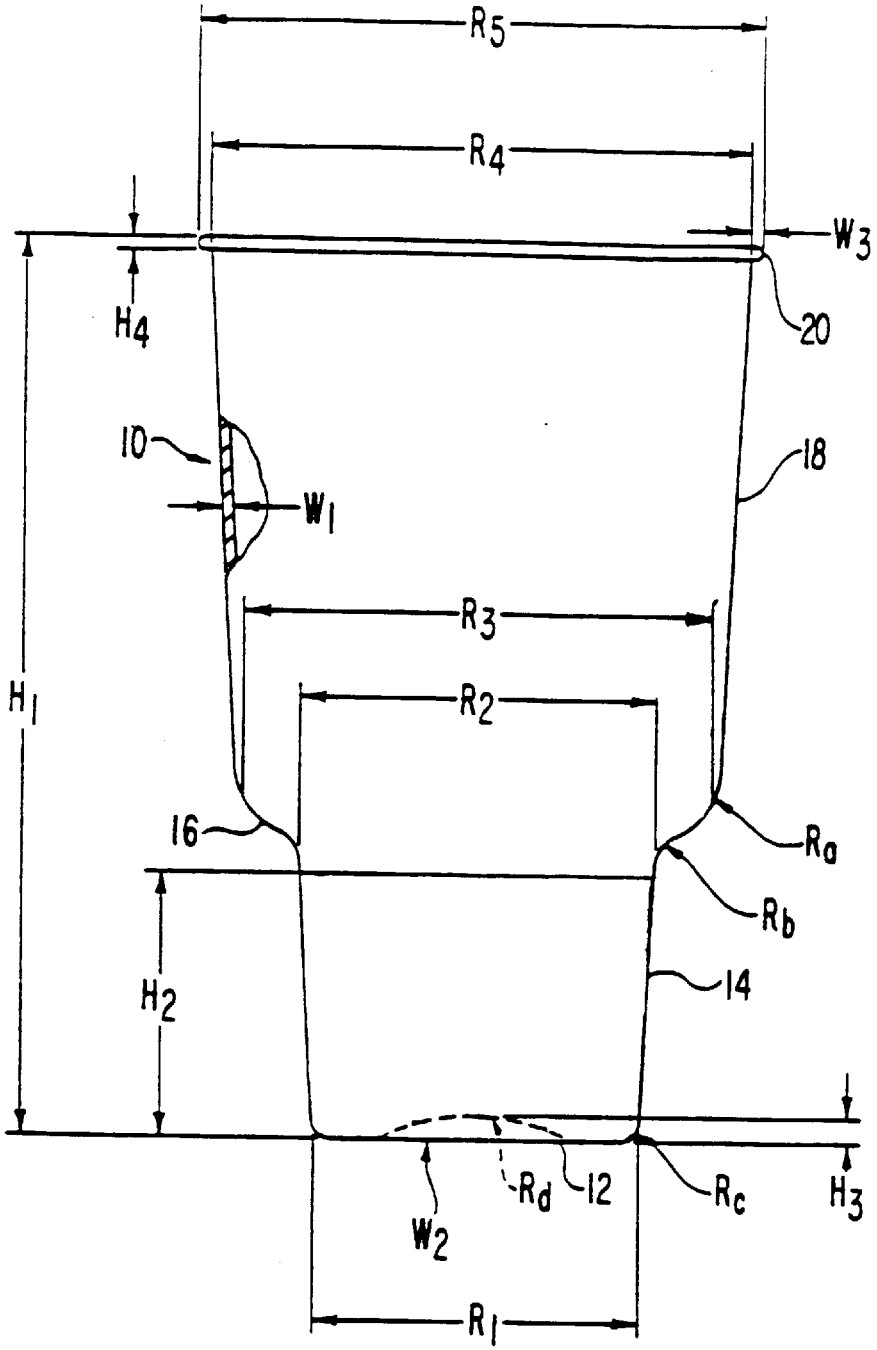
FIG. 5 is a side view of another embodiment of the container of this invention.

FIG. 5 depicts another embodiment in which the cup does not have fluted sides. The same reference numerals of FIG. 1 apply in all other respects and thus, do not require further description.

The cup 10 can be made by any suitable method known to those skilled in the art, such as injection molding, blow molding, vacuum forming, stretch molding, or thermal molding. The preferred method may use injection molding, which is well known to those skilled in the art.

In one embodiment of manufacturing the cup by injection molding, the provision of a lower body portion wall thickness which increases in an upward direction from the base to the upper body portion may provide a manufacturing advantage. This increasing thickness is produced by using a mold having a shape such that the thickness of the cavity in which the lower body portion is formed increases in the direction of the flow of material from the base area to the upper body portion. The injection rate may be 0.2 to 0.3 seconds in one embodiment.

The cavity of the section of the mold which will form the upper body portion 18 has a substantially constant, increasing, or decreasing relatively thin dimension. With some molds, difficulty in producing the cup of this invention having the upper body portion of relatively thin dimensions was encountered. For example, a conventional 32 ounce cup weighs about 42 grams, but the cup 10 of this invention weighs about 32 grams to about 35 grams.

Without wishing to be bound by any theory of operability, it is believed that the section of the mold with a cavity having the progressively increasing dimension provides relief from pressure of injection molding, thereby enabling the injection molding apparatus to inject the molten material into even the smallest crevices of the relatively thin section of the mold which will form the upper body portion of the cup.

A method used in an embodiment of the invention to manufacture the cup 10 from a molten plastic material may comprise the following steps: The molten plastic material is injected into a mold comprising a first section having a cavity of progressively increasing dimension (such as thickness) in the direction of flow of the molten plastic material. The molten plastic is then directed into a second section containing a second cavity of a substantially constant dimension (such as thickness). The dimension, or thickness, of the second cavity is less than the largest dimension, or thickness, of the first cavity.

The cup 10 can be made of any suitable material, such as high density polyethylene, polypropylene, styrene, or other suitable plastic materials as well as paper or other suitable combination of composite materials known to those skilled in the art. In the preferred embodiment, the cup 10 may be made of high density polyethylene or polypropylene. In the most preferred embodiment, the cup 10 is made of high density polyethylene (HDPE) made by Dow Chemical Company, designated IP-60, having a specific gravity of 0.91 to 0.97, and believed to have a density of 0.955 g/cc. Because of the unique construction of the cup 10, the amount of material needed for its production is about 20% less than would have been necessary using a conventional design and construction method.

Variations on the embodiments described above are possible. For example, the cup 10 is described herein as being circular in cross section because standard vehicle container receptacles for soft drink cans and similar articles are circular in cross section. However, equivalent structures of differing cross section, e.g., square or triangular cross sections, could be made following the principles of this invention. Where a square or other shaped cross section is used, it is preferred that the diagonal of such a cross section corresponds substantially to the diameter of the circular cross section.

Moreover, the container may utilize a ratio of height of the upper body portion to height of the lower body portion of about 3.0 to about 1.8. The container may utilize a ratio of the upper diameter of the upper body portion to the lower diameter of the upper body portion of about 1.09 to about 1.69. The container may utilize a ratio of the diameter of the lower body portion at the top thereof at a point where it meets the shoulder, to the diameter of the lower body portion at the base of about 0.95 to about 1.33. These ratios maximize beverage storage volume while still allowing the cup to fit in a standard sized vehicle cup holder and while minimizing the risk of the cup overturning while in such a holder.

The thickness of the lower body portion may increase in thickness in an upward direction from the base to the shoulder. The container may have an upper body portion with an overall greater diameter than that of the lower body portion. The container may have an upper body portion that increases in diameter as the upper body portion extends upward.

The container may have a lower body portion that increases in thickness from about 0.008 inch at the base to about 0.055 inch at the shoulder. The container may have a lower body portion that increases in thickness from about 0.020 inch at the base to about 0.044 inch at the shoulder. The container may have a lower body portion of about 1⅞ inches to about 2½ inches in length. The container may have a lower body portion of about two inches in length. The container may have a lower body portion that increases in diameter from about 2½ inches at the base to about 2⅛ inches at the shoulder. The container may have a lower body portion with a diameter that increases from about 2½ inches at the base to about 2¾ inches at the shoulder. The container may have an upper body portion of about 4.500 inches to about 5.250 inches in length. The container may have an upper body portion of about 4.9375 inches in length. The diameter of the upper body portion may increase from about 2.750 inches at the shoulder to about 4.650 inches at the opening. The diameter of the upper body portion may increase from about 2.875 inches at the shoulder to about 4.100 inches at the opening. The container may have an opening comprising a rim measuring about 1/16 inch to about ½ inch in height. The opening may comprise a rim measuring about 1/10 inch in height.

In one embodiment, a method of increasing strength of a container, said container comprising a base, a lower body portion extending substantially upward from said base, a shoulder attached to and extending radially outward from the lower body portion, and an upper body portion extending upwardly from the lower body portion, may comprise including in the lower body portion a plurality of vertically fluted sides. Each of the fluted sides may be substantially one surface. Each of the fluted sides may increase in thickness in an upward direction from the base to the shoulder. Each of the fluted sides may increase in thickness from about 0.008 inch at the base to about 0.055 inch at the shoulder. Each of the fluted sides may increase in thickness from about 0.020 inch at the base to about 0.044 inch at the shoulder. T h e diameter of the lower body portion may increase from about 2½ inches at the base to about 2¾ inches at the shoulder. The lower body portion may be about 1⅛ inches to about 2½ inches in length. The lower body portion may be about two inches in length. The diameter of the upper body portion may increase from about 2.750 inches at the shoulder to about 4.650 inches at the opening. The upper body portion may be about 4.500 inches to about 5.250 inches in length. The upper body portion may be about 4.9375 inches in length.

In another embodiment a method of injection molding a container from a molten plastic material comprises injecting the molten plastic material into a mold including a first section having a first cavity of a progressively increasing thickness in the direction of flow of the molten plastic material, and subsequently directing the molten plastic material to flow into a second section having a second cavity of a substantially constant thickness, the thickness of the second cavity being less than the largest thickness of the first cavity. The overall diameter of the lower body portion may be such that the lower body portion is of a lesser diameter than the upper body portion.

The embodiments described above provide a number of significant advantages. The unique shape of the cup 10 enables the cup 10 to fit most vehicle container receptacles, while still conforming its size to the standards of existing food service cup dispensers, fill height restrictions, lids, and straws.

Additionally, if utilized, the fluted sides 15 of the lower body portion 14 and/or the increasing thickness of the walls of the lower body portion may facilitate material flow in manufacture of the upper body portion so that the cup 10 can be produced from relatively thin materials, such as paper and plastic, and still hold a large volume of beverage without being top heavy. Finally, the increased strength of the upper body portion 18, when the cup is secured with the molded lid, means that the rim 20 may be reduced in size, thus allowing for better nesting of stacked cups and reduction in case cup size.

Of course, it should be understood that a wide range of changes and modifications can be made to the preferred embodiments described above. It is therefore intended that the foregoing detailed description be regarded as illustrative rather than limiting and that it be understood that it is the following claims, including all equivalents, which are intended to define the scope of this invention.

What is claimed is:

1. A beverage container comprising:

a base having a circumference sized to fit a cylindrically shaped vehicle cup holder;

a lower body portion extending upward from the circumference of said base sufficiently to extend above the vehicle cup holder;

a shoulder extending radially outward from said lower body portion; and an upper body portion, of a substantially constant thickness, extending upward from said shoulder and including an opening;

said base, said lower body portion, said shoulder, and said upper body portion being formed of a thermoplastic material into a unitary, fluid tight beverage container, a ratio of a height of the upper body portion to a height of the lower body portion being about 3.0 to about 1.8;

wherein a wall thickness of said lower body portion increases in an upward direction from said base to said shoulder and each of an inner and outer surface of said lower body portion cants outwards from said base to said shoulder relative to a center of the container.

2. The container of claim 1, wherein the shoulder provides a stabilizing area between the lower body portion and the upper body portion that rests against the vehicle cup holder.

3. The container of claim 2, wherein the sidewalls of the container are relatively thin and can hold approximately 32 to 48 ounces of a beverage.

4. The container of claim 2, wherein a ratio of an upper diameter of the upper body portion to a lower diameter of the upper body portion is about 1.69 to about 1.09.

5. The container of claim 1, wherein a ratio of a diameter of the lower body portion at a point near the shoulder to a diameter of the lower body portion near the base is about 1.33 to about 0.95.

6. The container of claim 1, wherein said upper body portion has an overall greater diameter than that of said lower body portion.

7. The container of claim 1, wherein said upper body portion increases in diameter as said upper body portion extends upward.

8. The container of claim 1, wherein said wall thickness increases from about 0.008 inch at said base to about 0.055 inch at said shoulder.

9. The container of claim 1, wherein said wall thickness increases from about 0.020 inch at said base to about 0.044 inch at said shoulder.

10. The container of claim 1, wherein said lower body portion is about 1⅞ inches to about 2½ inches in length.

11. The container of claim 1, wherein said lower body portion is about two inches in length.

12. The container of claim 1, wherein a diameter of said lower body portion increases from about 2½ inches at said base to about 2⅞ inches at said shoulder.

13. The container of claim 1, wherein a diameter of said lower body portion increases from about 2½ inches at said base to about 2¾ inches at said shoulder.

14. The container of claim 1, wherein said upper body portion is about 4.500 inches to about 5.250 inches in length.

15. The container of claim 1, wherein said upper body portion is about 4.9375 inches in length.

16. The container of claim 1, wherein a diameter of said upper body portion increases from about 2.750 inches at said shoulder to about 4.650 inches at said opening.

17. The container of claim 1, wherein a diameter of said upper body portion increases from about 2.875 inches at said shoulder to about 4.100 inches at said opening.

18. The container of claim 1, wherein said opening comprises a rim measuring about 1/16 inch to about ½ inch in height.

19. The container of claim 1, wherein said opening comprises a rim measuring about 1/10 inch in height.

20. The container of claim 1, wherein said base is circular.

21. A method of increasing strength of a container, said container comprising a base, a lower body portion extending upward from said base, a shoulder attached to and extending radially outward from the lower body portion, and an upper body portion having a substantially constant thickness extending upwardly from the lower body portion, comprising:

making a thickness of the lower body portion increase in an upward direction from said base to said shoulder; and making each of an inner and outer surface of said lower body portion cant outwards from said base to said shoulder relative to a center of the container.

22. The method of claim 21, wherein said thickness increases from about 0.008 inch at said base to about 0.055 inch at said shoulder.

23. The method of claim 21, wherein said thickness increases from about 0.020 inch at said base to about 0.044 inch at said shoulder.

24. The method of claim 21, wherein a diameter of said lower body portion increases from about 2½ inches at said base to about 2⅞ inches at said shoulder.

25. The method of claim 21, wherein said lower body portion is about 1⅛ inches to about 2½ inches in length.

26. The method of claim 21, wherein said lower body portion is about two inches in length.

27. The method of claim 21, wherein a diameter of said upper body portion increases from about 2.750 inches at said shoulder to about 4.650 inches at an opening formed at an end opposite said shoulder.

28. The method of claim 21, wherein said upper body portion is about 4.500 inches to about 5.250 inches in length.

29. The method of claim 21, wherein said upper body portion is about 4.9375 inches in length.

* * * * *